US010066912B2

(12) United States Patent
Grace

(10) Patent No.: US 10,066,912 B2
(45) Date of Patent: Sep. 4, 2018

(54) BROADHEAD MATCHED PRACTICE FIELD TIP AND RELATED METHOD OF USE

(71) Applicant: Grace Engineering Corp., Memphis, MI (US)

(72) Inventor: Nathaniel E. Grace, Fort Gratiot, MI (US)

(73) Assignee: Grace Engineering Corp., Memphis, MI (US)

( * ) Notice: Subject to any disclaimer, the term of this patent is extended or adjusted under 35 U.S.C. 154(b) by 0 days.

(21) Appl. No.: 15/789,229

(22) Filed: Oct. 20, 2017

(65) Prior Publication Data

US 2018/0188011 A1 Jul. 5, 2018

Related U.S. Application Data

(60) Provisional application No. 62/442,573, filed on Jan. 5, 2017.

(51) Int. Cl.
*F42B 6/08* (2006.01)
*A63B 69/00* (2006.01)

(52) U.S. Cl.
CPC ..... *F42B 6/08* (2013.01); *A63B 69/00* (2013.01); *A63B 2244/04* (2013.01)

(58) Field of Classification Search
CPC ..... F42B 6/08
USPC ..... 473/583, 582
See application file for complete search history.

(56) References Cited

U.S. PATENT DOCUMENTS 2,848,834 A * 8/1958 Cox ..... F41H 13/0006 43/1
3,012,786 A * 12/1961 Saunders ..... F42B 6/08 473/585
4,396,196 A * 8/1983 Drennan ..... F42B 6/08 473/585
5,082,292 A 1/1992 Puckett et al.
5,090,709 A 2/1992 Johnson
5,102,147 A 4/1992 Szeluga
5,112,063 A 5/1992 Puckett
5,286,035 A 2/1994 Ward
5,417,440 A 5/1995 Barrie et al.
5,564,713 A 10/1996 Mizek et al.
5,871,410 A 2/1999 Simo et al.
5,941,784 A * 8/1999 Mizek ..... F42B 6/08 473/584
6,174,252 B1 1/2001 Mizek
(Continued)

*Primary Examiner* — Alexander Niconovich
(74) *Attorney, Agent, or Firm* — Warner Norcross + Judd LLP

(57) ABSTRACT

An archery practice field tip and related method of use is provided, where the field tip has a first shape that is structurally different from a second shape of an actual hunting broadhead, but where the tip mimics the aerodynamics and flight characteristics of the hunting broadhead. The practice tip can be void of sharpened cutting edges, and can include a head on drag promoting element and/or a crosswind drag promoting element, either of which can be scoops, flanges, fins, holes and the like. The tip can have a head on aerodynamic drag that is within 40%, within 25%, within 10% and/or within 5% of the first head on aerodynamic drag of the hunting broadhead. The practice tip can have a crosswind aerodynamic drag that is within 40%, within 25%, within 10% and/or within 5% of the crosswind aerodynamic drag of the hunting broadhead.

20 Claims, 6 Drawing Sheets

(56) References Cited

U.S. PATENT DOCUMENTS 6,200,237 B1 3/2001 Barrie
6,283,880 B1 9/2001 Barrie
6,287,224 B1 9/2001 Liechty, II
6,517,454 B2 2/2003 Barrie et al.
6,626,776 B2 9/2003 Barrie et al.
6,669,586 B2 12/2003 Barrie et al.
6,910,979 B2 6/2005 Barrie et al.
6,997,827 B1 2/2006 Grace, Jr. et al.
7,182,706 B2 2/2007 Barrie
7,226,375 B1 6/2007 Sanford
7,314,419 B2 * 1/2008 Grace ..... F42B 6/08 473/583
7,677,995 B1 3/2010 Sanford
7,713,151 B2 5/2010 Fulton
7,771,298 B2 * 8/2010 Pulkrabek ..... F42B 6/08 473/583
7,905,802 B2 3/2011 Erhard
7,951,024 B2 5/2011 Mizek
8,105,188 B1 * 1/2012 Mercer ..... F42B 6/08 473/583
8,197,367 B2 6/2012 Pulkrabek et al.
8,398,510 B1 3/2013 Mizek et al.
8,449,415 B2 5/2013 Grace
8,449,416 B2 5/2013 Grace et al.
8,469,842 B2 6/2013 Mizek et al.
8,469,843 B2 6/2013 Mizek et al.
8,512,179 B2 8/2013 Pulkrabek et al.
8,684,869 B1 4/2014 Perry
8,758,176 B2 6/2014 Pedersen
8,852,038 B1 * 10/2014 Hyde ..... F42B 6/04 473/578
8,911,311 B1 12/2014 Mizek et al.
9,068,806 B2 6/2015 Pedersen
9,228,813 B1 1/2016 Pedersen
9,341,449 B2 5/2016 Pedersen
9,726,465 B1 * 8/2017 Moore ..... F42B 6/08
2006/0030438 A1 2/2006 Hajek
2006/0084535 A1 4/2006 Kuhn
2016/0076863 A1 3/2016 Pedersen
2016/0273892 A1 9/2016 Pedersen
2016/0273893 A1 9/2016 Pedersen

* cited by examiner

BROADHEAD MATCHED PRACTICE FIELD TIP AND RELATED METHOD OF USE

BACKGROUND OF THE INVENTION

The present invention relates to archery, and more particularly to a field tip that is ballistically and/or aerodynamically matched to a broadhead with cutting blades and a related method of use.

In the field of archery, there is a variety of broadheads used to harvest game, such as deer, elk, moose and other wildlife. Most broadheads have two or more sharpened cutting blades that are configured to cut tissue and blood vessels, and promote bleeding upon entry of the broadhead into the game. Some broadheads have blades that are replaceable relative to a ferrule of the broadhead. A popular fixed, replaceable three-blade construction is the Striker™ available from G5 Outdoors LLC. Other broadheads are of a monolithic single-piece structure with a number of permanent blades with sharpened cutting edges. A well-established, standard monolithic broadhead in the industry is the Montec™ which is also available from G5 Outdoors LLC. Yet other broadheads are referred to as mechanical broadheads, which include blades that move and/or expand relative to a ferrule. A common mechanical broadhead is the Havoc™, also available from G5 Outdoors LLC.

An issue with most broadheads is that they typically fly differently from practice field tip points used by an archer in everyday target practice. Thus, for an archer to confirm that the bladed broadheads fly along a desired trajectory resulting in an accurate hit on a target, the archer must shoot the broadhead into a target one or more times during practice. When an archer performs this practice with the broadhead several things can occur. First, the sharpened blades of the broadhead impact the material of the target, which is usually foam, thermoplastic or a fabric material. Upon such impact, the sharpened blades can become dulled. This is undesirable—if the broadhead is later shot at game, it will not have the same cutting effect and may lead to a less humane harvest. Second, the broadhead may fly substantially differently than the archer's field tip points, which typically are designed so that they are more aerodynamic and produce less drag than the broadhead. In such a case, the broadhead may not impact the target at all, and instead may impact the ground or other objects beyond the target. Such impact can damage or destroy the broadhead, and in many cases, substantially dull the blade. Third, if the broadhead is a mechanical broadhead, upon impact with the target, the blades deploy. After extracting the broadhead from the target, the archer must carefully reset the blades to a pre-flight, un-deployed state. This can be time consuming, particularly if portions of the target become lodged in parts of the broadhead's features.

Some manufacturers of mechanical expandable broadheads have attempted to address these issues by molding a practice broadhead as a single unitary structure that has the exact same shape and structure as the actual mechanical broadhead, but in the retracted, un-deployed configuration. Thus, the practice broadhead has a tip and blades that are un-deployed—and incapable of deploying—relative to a body of the practice broadhead. Due to the practice broadhead being virtually identical in structure to the actual mechanical broadhead in the un-deployed state, the practice broadhead usually will fly aerodynamically similar to the actual broadhead. Because the practice broadhead has the exact same structure as the un-deployed actual broadhead, however, it can be difficult and complicated to mold. Further, due to the same structure, the practice broadhead includes blades that tend to tear up and destroy the target, much more than conventional field tips.

Accordingly, there remains room for improvement in the field of archery practice tips that mimic the flight of actual bladed broadheads for improved and consistent accuracy.

SUMMARY OF THE INVENTION

An archery arrow practice field tip and related method of use is provided, where the tip has a first shape that is structurally different from a second shape of an actual hunting broadhead, but where the tip mimics the aerodynamics and flight characteristics of the actual hunting broadhead.

In one embodiment, the practice tip includes a head on aerodynamic drag promoting element configured to regulate the amount of head on aerodynamic drag experienced by the practice field tip in flight. Optionally, the head on aerodynamic drag promoting element increases the amount of head on drag force generated by the practice tip as air moves over the surfaces of the practice tip, for example, in flight.

In a further embodiment, the practice tip includes a crosswind drag promoting element configured to regulate the amount of crosswind aerodynamic drag experienced by the practice field tip in flight. Optionally, the crosswind aerodynamic drag promoting element increases the amount of crosswind drag force generated by the practice tip as air moves over the surfaces of the practice tip, for example in flight, when experiencing a crosswind relative to the trajectory of the practice tip.

In a further embodiment, the practice tip and its ferrule can be void of any cutting edges and/or sharpened cutting edges. This is so the practice tip might not induce as much damage on a practice target, thereby increasing target longevity.

In another embodiment, the practice tip includes a tip and a distal stem, the stem configured for attaching the practice tip to an arrow and/or an arrow insert. The practice tip can include both the crosswind aerodynamic drag promoting element and the head on aerodynamic drag promoting element. Each of these elements can be disposed between the stem and the tip.

In still another embodiment, the head on aerodynamic drag promoting element is a first scoop having a first concave surface that opens forward generally toward the tip. The crosswind aerodynamic drag promoting element is a second scoop having a second concave surface that opens outward, away from the longitudinal axis. The two scoops can be contiguous with and/or overlap one another. Each of the respective scoops can produce respective drags to mimic the flight characteristics of the actual hunting broadhead.

In even another embodiment, the practice tip and the actual hunting broadhead can be sold as a kit. One, two, three or more of each can be included in the kit. An archer can practice with the practice tip, then switch to the hunting broadhead when ready to pursue game. The practice tip can be less expensive, and less costly to replace than the actual hunting broadhead.

In yet another embodiment, a method is provided. The method can include determining at least one of a first head on aerodynamic drag and a first crosswind aerodynamic drag of a hunting broadhead. The hunting broadhead having a first shape and a sharpened cutting edge forming a practice field tip, including a second shape different from the first shape, and a head on aerodynamic drag producing element not present on the hunting broadhead. The practice field tip being void of a sharpened cutting edge so that the practice field tip has at least one of: (a) a second head on aerodynamic drag that is less than 40% above and less than 40% below the first head on aerodynamic drag of the hunting broadhead; and (b) a second crosswind aerodynamic drag that is less than 40% above and less than 40% below the first crosswind aerodynamic drag of the hunting broadhead.

In a further embodiment, the method can include forming the practice field tip so that the practice field tip has the second head on aerodynamic drag that is less than 25% above and less than 25% below the first head on aerodynamic drag of the hunting broadhead, and so that the practice field tip has a second crosswind aerodynamic drag that is less than 25% above and less than 25% below the first crosswind aerodynamic drag of the hunting broadhead.

In still a further embodiment, the method can include forming the practice field tip so that the practice field tip has the second head on aerodynamic drag that is less than 10% above and less than 10% below the first head on aerodynamic drag of the hunting broadhead, and so that the practice field tip has a second crosswind aerodynamic drag that is less than 10% above and less than 10% below the first crosswind aerodynamic drag of the hunting broadhead.

In still yet another embodiment, the method can include forming the practice field tip so that the practice field tip has the second head on aerodynamic drag that is less than 5% above and less than 5% below the first head on aerodynamic drag of the hunting broadhead, and so that the practice field tip has a second crosswind aerodynamic drag that is less than 5% above and less than 5% below the first crosswind aerodynamic drag of the hunting broadhead.

The current embodiments and related methods of use provide benefits with regard to archery arrow practice tips that previously have been unachievable. For example, with the archery practice tips, an archer can practice with those tips instead of a corresponding hunting broadhead that is much more costly to replace and/or repair. The archer, however, can be assured that the flight characteristics and subsequent point of impact of the practice tip will closely mimic, if not be identical to, those of the actual hunting broadhead. Further, the practice tips can be substantially less costly to manufacture, and can be less prone to damage due to their simplicity. In addition, where the practice tips do not include sharpened cutting edges, those tips impart less damage and destruction to a practice target into which the tips are shot on arrows by an archer. This can increase the longevity of the practice target. Further, an archer can utilize the practice tips to properly set up their archery equipment, for example the sight on their bow, in a manner that later allows the archer to switch directly to the actual hunting broadheads with little to no change in the point of impact. This enables the archer to shoot during off-season with the practice tips, then switch to the actual hunting broadheads without concern of them flying much differently.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
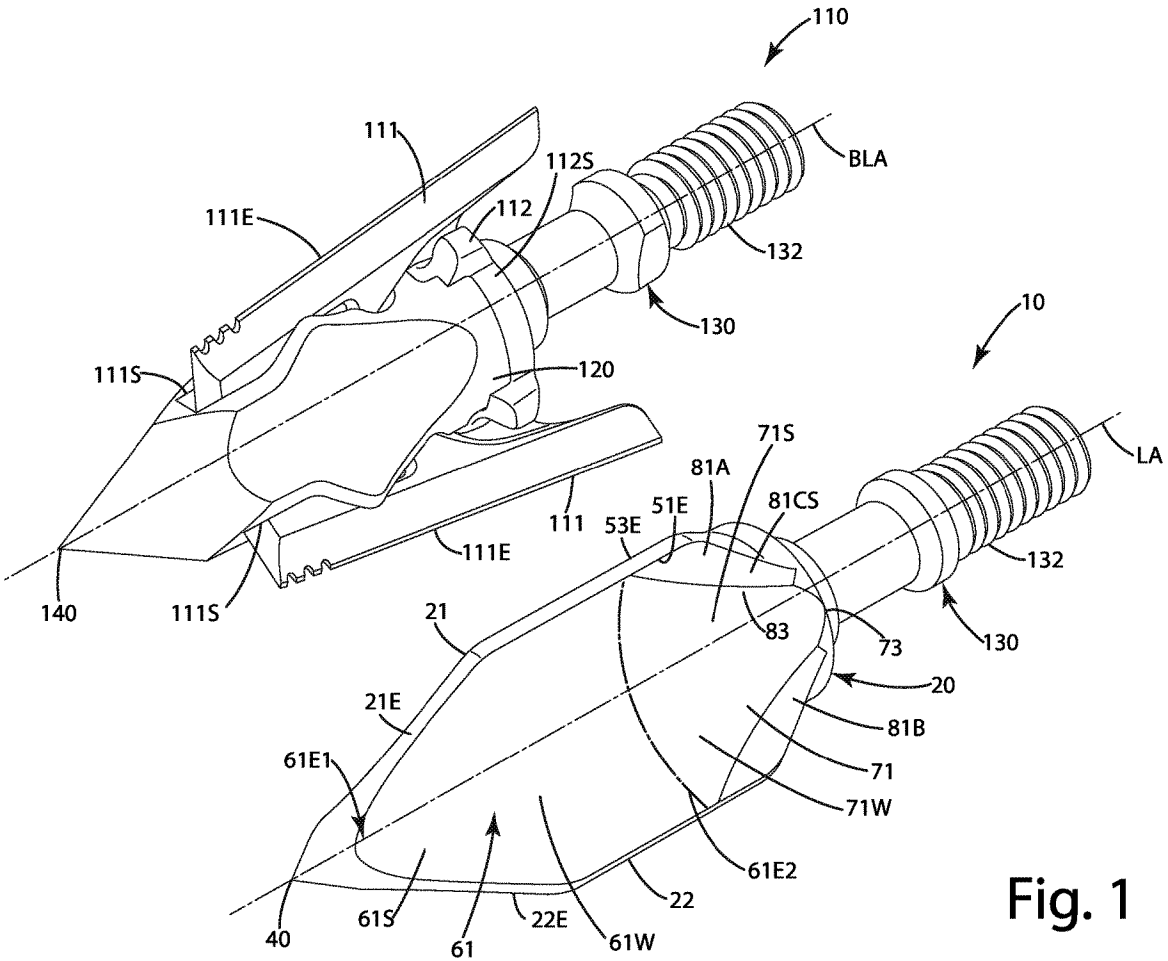
FIG. 1 is a perspective view of the archery practice tip of a current embodiment adjacent an actual hunting broadhead, the two having similar aerodynamic and flight characteristics despite being of different physical structure.

A current embodiment of the practice tip 10 in conjunction with a corresponding hunting broadhead 110 is illustrated in FIGS. 1-4. As described herein, the practice tip 10 is aerodynamically designed to mimic the aerodynamics and flight characteristics of a hunting broadhead 110 that is in the form of a rearward deploying, three-blade mechanical broadhead. It will be appreciated that the practice tip 10 can be aerodynamically designed to mimic other types of hunting broadheads, for example, monolithic bladed broadheads, fixed replaceable blade broadheads, fishing arrow tips, other mechanical broadheads, as well as hunting broadheads having one, two, three, four or more cutting blades that may or may not be sharpened, but otherwise are designed to cut through tissue game.

The practice tip 10 described herein also can be modified so that it can address and mimic both the crosswind aerodynamic drag and the head on aerodynamic drag, or each of these types of drags individually, depending on the type of hunting broadhead to which the practice tip is configured to correspond.

The practice tip 10 can be manufactured from a variety of materials using a variety of techniques. For example, the practice tip can be constructed from metal, such as steel, aluminum, brass and various alloys, composites, thermoplastics and combinations of the foregoing. Indeed, various components of the practice tip can be constructed from one material, while others are constructed from another material. The practice tip can be manufactured using a variety of techniques, such as CNC milling techniques to remove material from a piece of bar stock, metal injection molding techniques, direct metal deposition techniques, metal molding techniques, welding techniques, plastic injection molding techniques, composite layering techniques and the like.

The practice tip further can be constructed to include parts that are attachable and/or detachable manually or with the use of tools. In this manner, a user can add or remove certain aerodynamic drag promoting or reducing elements or features to the practice tip to more closely mimic the inflight aerodynamic characteristics of a hunting broadhead to which the practice tip is suitable to correspond.

With reference to FIGS. 1-4, the practice tip 10 and the actual hunting broadhead 110 to which the practice tip is aerodynamically matched will be described in more detail. Starting with the broadhead 110, that unit is in the form of a mechanical broadhead having three rearward deploying cutting blades 111 that effectively come out and away from the ferrule 120, generally transitioning from a retracted mode to a deployed mode. In the deployed mode, the cutting blades are of a dimension substantially larger so as to be able to inflict large cuts in tissue. The ferrule 120 is joined with a stem 130. The stem can include threads 132 that are configured to interface with a corresponding threaded hole in an arrow insert or a portion of an arrow (not shown). With the threaded stem, the broadhead 110 can be secured to an arrow and readied for use.

The broadhead 110 can include a penetrating end or tip 140. This penetrating tip or end 140 can be sharpened to a point that is conducive to penetrating the tissue, skin and/or hide of game. The tip 140 can be integrally formed with the remainder of the ferrule 120. Alternatively, although not shown, the tip 140 can be joined with a separately constructed cut on contact blade or tip that is fastened with a fastener in the region of the tip 140. As illustrated, the tip can form part of the ferrule. The ferrule 120 also can define one or more slots 111S within which the blades 111 are slidably disposed. The blades 111 themselves can include cutting edges 111E, which may or may not be sharpened, but which generally are configured to cut tissue of game.

The broadhead 110 optionally can be constructed to include a blade retainer 112 which is configured to retain the blades 111 in the deployed mode during flight, yet enable release of the blades 111 upon impact of the broadhead 110 with game or a target. The retainer and/or ferrule 120 can define a shoulder 112S. This shoulder 112S can be configured to directly engage a rim or portion of an arrow insert or an arrow directly when the stem is joined with the same.

The broadhead 110 can include a broadhead longitudinal axis BLA that extends through the center of the broadhead 110, generally from the end 130E of the stem 132 through the tip 140 of the broadhead. The broadhead also can define a length L1 that extends from the tip 140 to the shoulder 112S. This length, of course, can vary depending on the type of hunting broadhead that is used. The length L1 can optionally be about ¼ inch to about 3 inches, further optionally about ½ inch to about 2 inches, and even further optionally about 1 inch to about 1½ inches.

The broadhead 110 can be aerodynamically analyzed, for example in a wind tunnel, to measure a variety of aerodynamic drag forces exerted on the broadhead during a typical inflight trajectory. As described further below, the data collected from the analysis can be used to construct the practice field tip 10 so that the practice tip has similar aerodynamic properties and inflight characteristics as the hunting broadhead 110. To promote the broadhead and its corresponding field tip, a manufacturer or supplier or distributor of the broadhead can sell or offer the broadhead plus the aerodynamically matched practice tip 10 in a kit. In such a kit, the actual hunting broadhead 110 can be packaged with the practice tip 10. Optionally, three, four, five, six or a dozen of the actual hunting broadheads 110 can be packaged with one, two, three, four, five, six, etc. practice tips 10.

With the kit, an archer can prepare arrows and attach to them the practice tips. The archer can utilize and shoot the practice tips and arrows from an archery bow. The archer can use the practice tips to calibrate sight and other accessories on their bow during off-season. When a particular game season begins, the archer can simply remove from an arrow the practice tip 10, exchanging it for a matching broadhead 110. The archer should not perceive a significant change in the flight characteristics or point of impact when going from the practice tip to the actual broadhead, because again, the practice tip is aerodynamically matched and/or ballistically matched to the broadhead.

Optionally, depending on the particular broadhead shape, the corresponding shape of the practice tip can vary substantially. In general, however, the shape S1 of the actual broadhead 110 is of a first structural and aesthetic configuration, whereas the shape S2 of the practice tip 10 is of a second structural and aesthetic configuration that is different from the first shape S1. Many features, and particularly, the blades of the actual broadhead, can be deleted from the practice tip construction for simplicity. As mentioned above, to reduce the complexity and the manufacturing costs associated with the practice tip 10, it can be constructed to be void of any cutting blades, whether sharpened or not. It also can be void of any retainers or other structures configured to retain blades in connection with a ferrule 20.

The practice tip 10 can include a ferrule 20. The ferrule 20 can be joined with a stem 30 that is configured to be joined with an arrow insert or an arrow directly. For example, the stem 30 can include threads 32 that thread into an arrow insert (not shown) having corresponding threads. The stem 30 can extend to the end 30E of the practice tip 10. The practice tip 10 also can include a tip 40 and a shoulder 12S. Generally, the shape S2 of the practice tip 10 varies from the shape S1 of the broadhead from the shoulder to the tip. Of course, some features can be similar in both, but optionally, no features are identical from one to the other. Optionally, the stems of the practice tip and the actual broadhead can be quite similar, if not identical to another, as those components typically do not affect the aerodynamic flight of the arrow to which the practice tip and/or or actual broadhead 110 are attached. Indeed, those components of the stems 30, 130 are disposed inside the arrow, so they are not typically exposed to air passing over them, and thus create little to no aerodynamic drag.

The ferrule 20 can include a length L2 that extends from the tip 40 to the shoulder 12S. This length, of course, can vary depending on how the practice tip is matched to the hunting broadhead. The length L2 can optionally be about ¼ inch to about 3 inches, further optionally about ½ inch to about 2 inches, and even further optionally about 1 inch to about 1½ inches.

Figure 4:
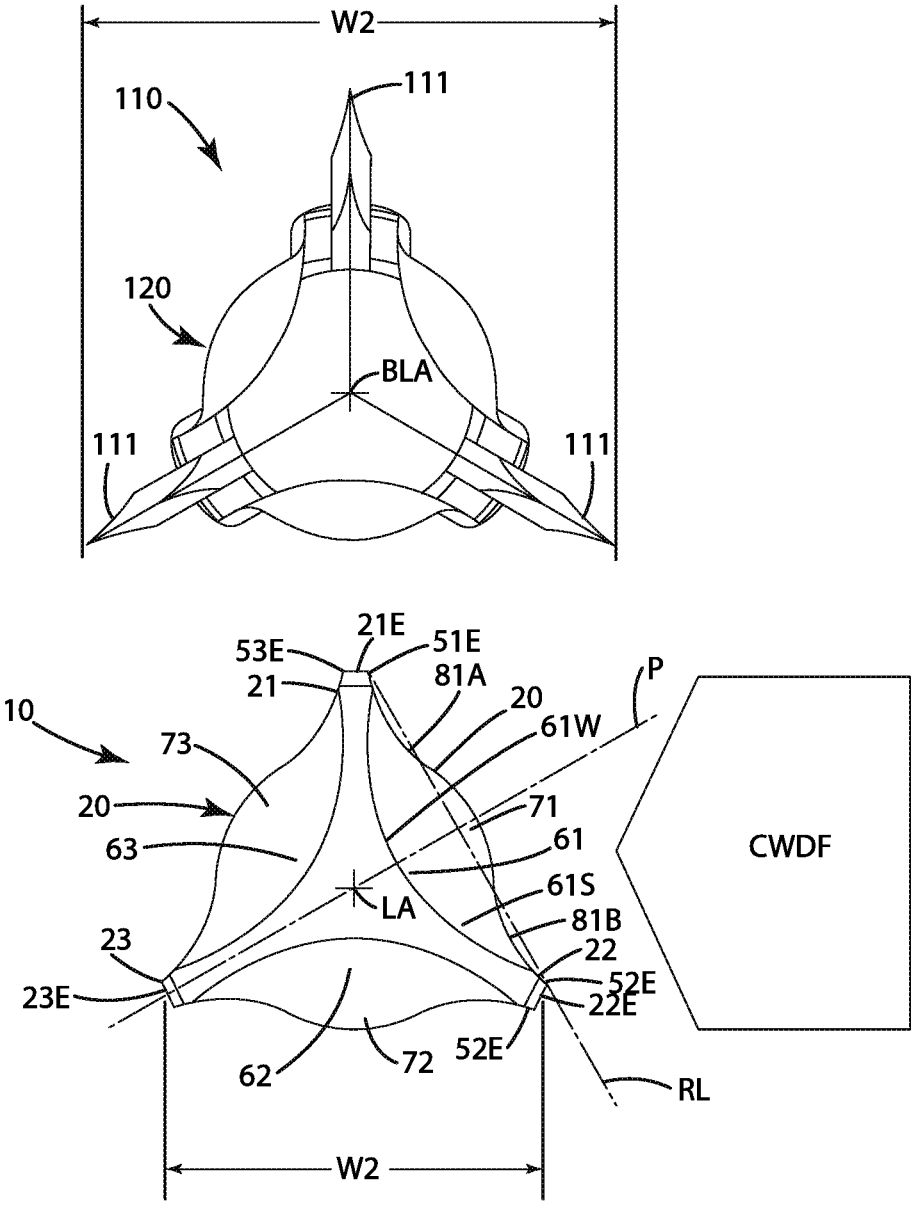
FIG. 4 is a front view of the archery practice tip adjacent the actual hunting broadhead.

As illustrated, for example, in FIG. 1, the practice tip 10 can include a tip 40. The tip can be substantially conical. The tip can extend rearwardly to one or more fins 21, 22, 23. These fins can include an outer edge 21E, 22E and 23E. These edges can extend to the tip 40 and rearward, generally toward the shoulder 12S. The edges can be generally planar as shown in FIG. 4 when extending from a first scoop 61 upper edge 51E to a second scoop 63 upper edge 53E. Of course, in some cases, the fin edges or landings 21E, 22E, 23E can be rounded, curved and/or angular. Optionally, these edges, however, are not formed as cutting edges conducive to cutting or slicing through tissue. Further optionally, these edges are not sharpened and/or honed in a manner to produce a sharp cutting edge. Thus, in turn, the entire practice tip 10 is void of any cutting edges, and in particular, any sharpened and/or honed cutting edges.

The practice tip 10 can include one or more aerodynamic drag promoting elements. These aerodynamic drag promoting elements can come in a variety of forms, for example, in the form of slots, grooves, holes, flippers, projections, and as shown in the current embodiment, in the form of one or more scoops. It is noted that these aerodynamic drag promoting elements specifically and intentionally promote an increase in aerodynamic drag forces on the practice tip as the practice tip moves through air or has air moved past it. This contrasts and is a significant deviation from previous archery broadheads that include features that intentionally decrease—rather than increase—the drag forces exerted on the broadhead to improve the aerodynamic characteristics of the broadheads.

Figure 2:
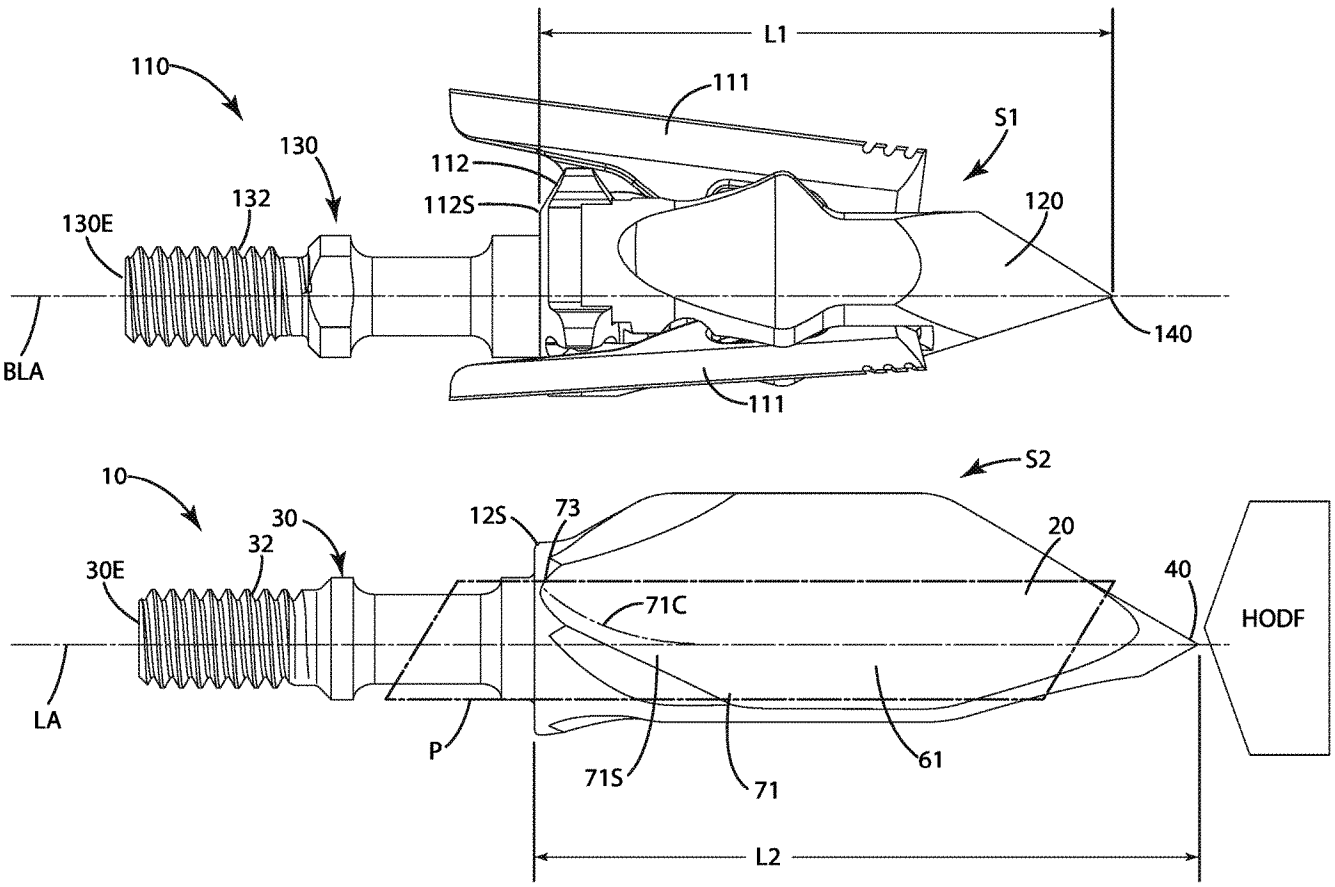
FIG. 2 is a side view of the archery practice tip adjacent the actual hunting broadhead.
Figure 3:
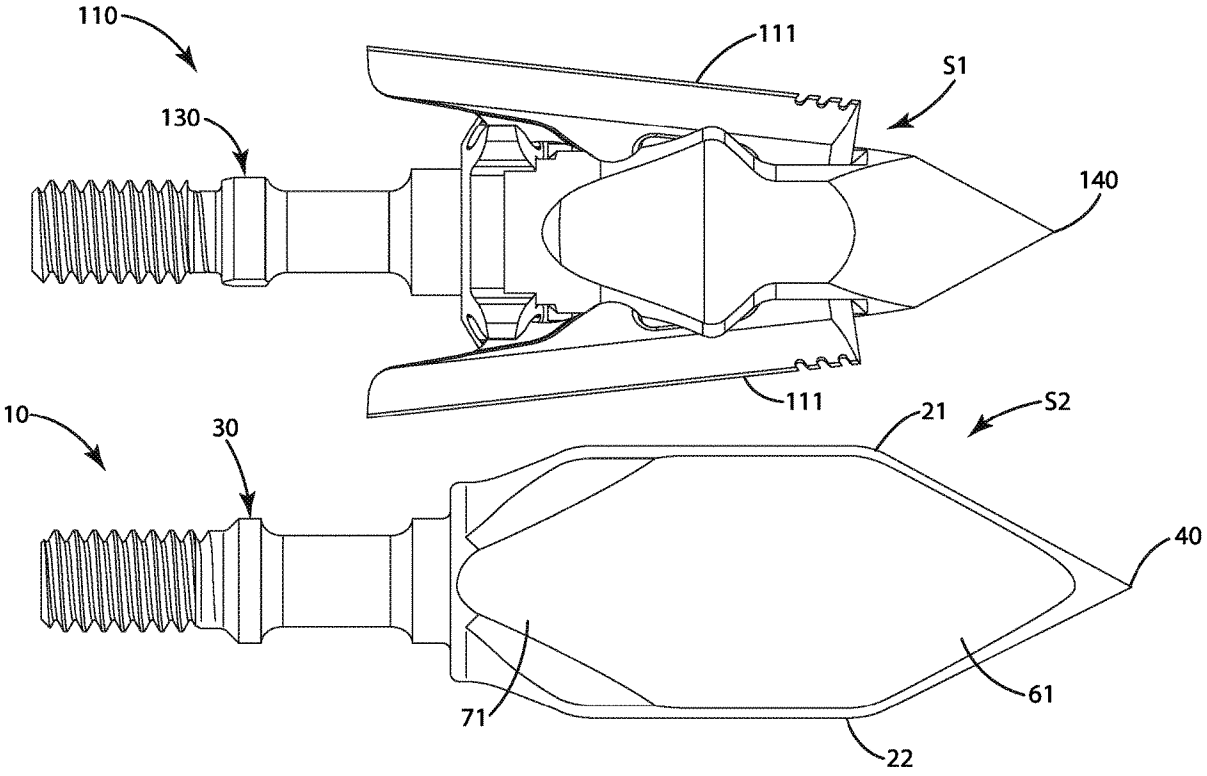
FIG. 3 is a side axial view of the archery practice tip adjacent the actual hunting broadhead.

More particularly, as shown in FIGS. 1, 2 and 4, the practice tip 10 optionally can include one or more crosswind aerodynamic drag promoting scoops 61, 62 and 63, and further optionally, include one or more head on aerodynamic drag promoting scoops 71, 72 and 73. Each of the respective scoops induces or promotes aerodynamic drag encountered by the tip, head on or due to a crosswind. For example, aerodynamic head on drag force HODF is generated when the tip is attached to an arrow flying through the air along a designated trajectory. As a further example, aerodynamic crosswind drag force CWDF is generated when the tip is attached to an arrow flying through the air but encounters a crosswind that is transverse to the longitudinal axis LA of the practice tip 10. Crosswinds of 5, 10, 15, 20, 25, 30 mph, or more or less, can produce this crosswind drag force, thereby causing the broadhead flying through such crosswind to move in the direction that it is pushed by the crosswind.

The crosswind aerodynamic drag promoting scoops 61, 62 and 63 can be defined by the ferrule 20 between the respective fins 21, 22 and 23. Although shown as three scoops, any number of crosswind drag promoting scoops can be utilized with the current embodiments. The crosswind aerodynamic drag promoting scoops are similar if not identical, so only the scoop 61 will be described in detail here. The scoop 61 can include a concave surface 61S. This concave surface 61S can be rounded and/or curvilinear. Optionally, however, the surface can be angled and/or can include a plurality of facets if desired. The concave surface 61S can be of a constant, uniform curvature from its first end 61E1 adjacent the tip to its second end 61E2, shown in broken lines, adjacent the head on aerodynamic drag promoting scoop 71. As an example, the scoop 61 can have a constant radius and/or curvature as it extends from the first fin 21 to the second fin 22, or where it terminates at the first fin outer edge 51E and the second fin outer edge 52E which are immediately adjacent the outermost edges or landing 21E and 22E.

The crosswind drag promoting scoop 61 also can include a well 61W. This well can correspond to an apex portion of the surface 61S of the scoop 61 that is closest to the longitudinal axis LA. This well can be of a curvature that is similar to the remainder of the surface 61S. The forward end 61E1 of the scoop 61 can begin a distance rearward of the tip 40 and can extend about one-half to about two-thirds the distance of the length L2. Of course other distances can be selected depending on the flight characteristics of the practice tip.

Optionally, the practice tip 10 can be constructed so that adjacent fins, for example fin 21 and fin 22, can be connected via a reference line RL. In particular, this reference line RL can extend through the edges 51E and 52E adjacent the crosswind scoop 61. In this manner, the crosswind drag promoting scoop 61 can be configured so that it does not extend beyond the reference line RL. Of course, the head on drag promoting scoop 71, as described further below, can extend beyond this reference line RL when viewing the practice tip 10 from a front view as shown in FIG. 4.

The scoop 61 also can be constructed to transition and/or merge with the head on drag promoting scoop 71. For example, the well 61W of the scoop 61 can transition to and be contiguous with the well 71W of the head on drag promoting scoop 71. This head on aerodynamic drag promoting scoop 71 can be constructed to include a concave surface 71S. This concave surface can be concave and in some cases can include multiple curvatures depending on the application. As illustrated in FIG. 2, the surface 71S can include a curvilinear line or curvature 71C that extends within a plane P, which itself is coincident with longitudinal axis LA. This curvature 71C can curve away from the longitudinal axis LA within the plane P. Of course, in other planes (not shown) parallel to the plane P, the concave surface 71S can include other curvatures or be of other curved lines within those other planes. Further, the surface 71S can be curvilinear and/or rounded in transitioning from adjacent the first fin 21 to adjacent the second fin 22.

The head on aerodynamic drag promoting scoop 71, as mentioned above, can extend from the crosswind drag promoting scoop 61 rearward toward the shoulder 12S. The scoop 71 can terminate at an outer scoop lip 73. This outer scoop lip can be generally rounded and/or flat. In this configuration, the crosswind aerodynamic drag promoting scoop 61 is disposed between the tip 40 and the head on aerodynamic drag promoting scoop 71, and optionally, between the tip 40 and the shoulder 12S.

Optionally, as shown in FIGS. 1 and 4, the practice tip 10 can be outfitted with head on aerodynamic drag reducing scoops 81A and 81B. The scoops can be reproduced on or adjacent the other head on scoops 72 and 73, so will only be described once here, in connection with the scoop 71. The scoops 81A and 81B can be of a different curvature and can include a different curved surface 81CS from the scoop 71. The surface 81CS is shown as a concave surface, but alternatively can be flat, planar or multifaceted. The surface 81CS can meet the surface 71S at a ridge or interface 83. This interface can be rearward of the end 61E2 of the crosswind drag promoting scoop 61 as shown, or alternatively can extend forward of that. The curved surface 81CS of the aerodynamic drag reducing scoop 81A can extend upward toward the outer lip 73 of the head on aerodynamic drag promoting scoop 71. It also can extend upward to the fin 21 and can terminate adjacent the edge 21E, more particularly the edge 51E. It is to be noted that again this scoop reduces aerodynamic drag. Thus, the practice tip 10 can include both aerodynamic drag promoting elements as well as aerodynamic drag reducing elements. Optionally, in some applications, such additional scoops or head on drag reducing features can be eliminated from the practice tip.

As mentioned above, the practice tip 10 can be configured to mimic the flight characteristics and aerodynamics of an actual broadhead 110. The shape S2 of the practice tip, however, can be different from the shape S1. In addition, the length L2 of the practice tip can be different from the length L1 of the broadhead 110. For example, the length L2 can be longer or greater than the length L1. Optionally, these lengths can be equal or reversed. As an example, the length L2 can be optionally at least 10% greater, further optionally at least 20% greater, even further optionally at least 30% greater and yet further optionally at least 40% greater than the length L1. Further optionally, the practice tip 10 can include a width W2. This width W2 can be less than the width W1, as shown in FIG. 4, of the actual hunting broadhead 110. Of course, in other applications, these widths can be equal or reversed. As an example, the width W1 can be optionally at least 5% greater, yet further optionally 10% greater, further optionally at least 20% greater, even further optionally at least 30% greater and yet further optionally at least 40% greater than the width W2.

A series of experiments were conducted to evaluate the aerodynamic and flight characteristics of the broadhead 110, with the goal of producing the practice tip 10 of a different overall shape, but having similar aerodynamic and flight characteristics so as to fly nearly the same as the actual hunting broadhead 110 when shot on an arrow from an archery bow.

In general, the same crosswind drag forces and head on drag forces can be exerted on a proposed practice tip, for example the practice tip 10. The data can be collected relative to that practice tip and compared to the aerodynamic data collected in conjunction with the actual hunting broadhead 110. The surfaces of the practice tip 10 can be modified and additional crosswind drag promoting elements and/or head on drag promoting elements can be added to the practice tip to slow down the practice tip so that it flies more like the broadhead and/or catches more crosswind so the practice tip deflects laterally in a manner similar to the actual broadhead 110.

To begin the testing, trajectory testing was conducted to evaluate head on aerodynamic drag on a practice tip and on an actual broadhead, each joined with identical arrows, when shot from an archery bow along a trajectory. In particular, a Prime Centergy archery bow available from G5 Outdoors, LLC of Memphis, Mich., was set to 65 pounds. First, the bow was shot to propel an arrow having the hunting broadhead 110 attached to it along a 60 yard parabolic trajectory. The velocity of the arrow and associated hunting broadhead was measured at 0 yards, 20 yards, 30 yards, 40 yards and 60 yards from the bow with a LabRadar Ballistic velocity Doppler Radar Chronograph, commercially available from Infinition Inc of Trois-Rivieres, Quebec, Canada. These shots and the associated measurements yielded the data in Table 1 below.

TABLE 1

| Velocities at Different Distances | | |
|---|---|---|
| Distance | Actual Broadhead | Practice Tip |
| 0 Yds. | 278 fps | 278 fps |
| 20 Yds. | 265 fps | 266 fps |
| 30 Yds. | 259 fps | 261 fps |
| 40 Yds. | 254 fps | 257 fps |
| 50 Yds. | 247 fps | 252 fps |
| 60 Yds. | 242 fps | 248 fps |

As can be seen from the above data, the velocity of the practice tip is optionally within about 20%, further optionally within about 15%, even further optionally within about 10%, yet further optionally within about 5%, and yet further optionally within about 1% of the velocity of the actual hunting broadhead at the various distances. As used in herein, the phrase "within about X % of Y" can mean a range that is less than or equal to X % above or below Y. Using other comparative techniques, the practice tip can be propelled at a velocity ±1 fps, ±2 fps, ±3 fps, ±4 fps, ±5 fps, ±6 fps, ±7 fps, ±8 fps, ±9 fps or ±10 fps of the velocity of actual broadhead at any of the yardages in Table 2. From the data, the practice tip thus had inflight characteristics and a corresponding trajectory and measured velocities that very closely approximated the inflight characteristics and corresponding trajectory and measured velocities of the actual broadhead, despite the tip and broadhead being of markedly different shapes and dimensions.

Second, wind tunnel testing was performed on scaled models of the practice tip and an actual broadhead, for example, the Deadmeat™ 100 grain broadhead commercially available from G5 Outdoors, LLC. The wind tunnel used was a modified Airtec Scout wind tunnel, commercially available from Pitsco Inc. of Pittsburgh, Kans. This wind tunnel is capable of air speeds of at least 4000 feet per minute (fpm) propelled head on, past a stationary fixture upon which the scaled models were placed. This wind tunnel and its custom made fixture also is capable of measuring the force exerted by the wind (that is the aerodynamic drag force or an equivalent) in grams.

Figure 6:
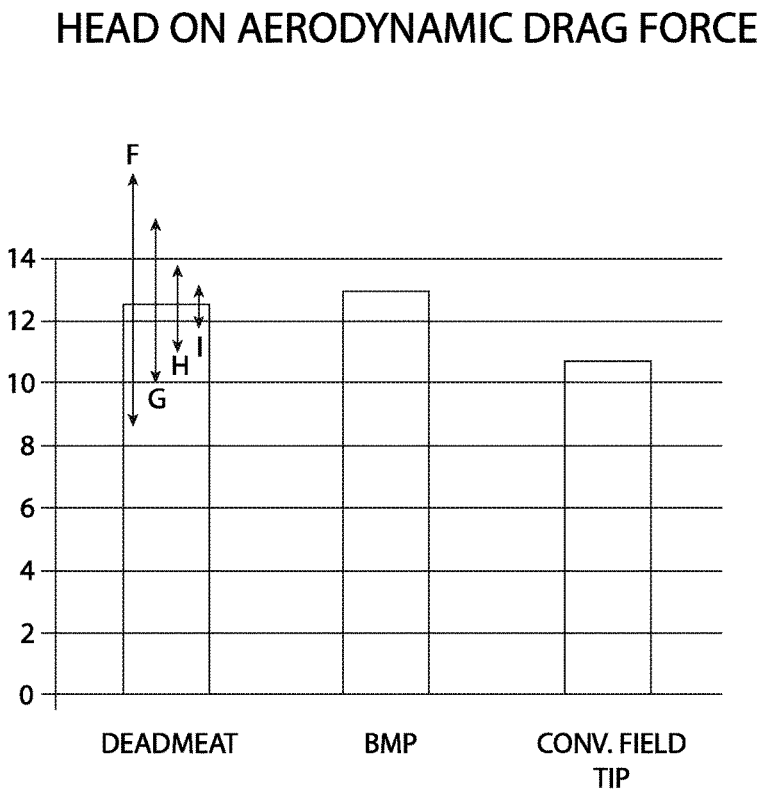
FIG. 6 is a bar chart illustrating a comparison of head on aerodynamic drag of the practice tip of the current embodiment with an actual hunting broadhead that the practice tip is designed to mimic in flight, and with a conventional field tip.

To perform the head on testing, the practice tip 10, scaled up 3× from an actual size, was placed on a stationary fixture so that the tip was facing directly into the wind, with the longitudinal axis parallel to the head on wind. As a result, the practice tip was subjected to an aerodynamic head on drag force HODF, for example, as shown in FIG. 2. This head on drag force is created by air moving at 4000 fpm, from tip to stem of the practice tip. The air can generally be propelled along lines parallel to the longitudinal axis LA, over the various surfaces of the practice tip 10. As the tip was subjected to the air flow, the wind tunnel machine measured the head on aerodynamic drag force of the practice tip in grams. Five measurements were taken for the practice tip, and then averaged. The same procedure was repeated for the 3× scaled up actual broadhead, that is, the Deadmeat™ broadhead shown in FIGS. 1-4. If desired, the order of the measurements can be reversed, with the actual broadhead being measured first, then the practice tip, or other tips. Lastly, the same procedure was repeated for a 3X scaled up conventional field tip. This conventional field tip can include a cylindrical base transitioning to a conical tip, and includes no designated or designed in drag promoting or reducing features. The conventional field tip measured can be a 3X scaled up version of Saunders Bullet Point, which is commercially available from Lancaster Archery of Lancaster, Pa. The average head on aerodynamic drag forces in grams for each of the scaled up Deadmeat™ broadhead, the ballistically matched practice tip (BMP) and the conventional field tip are presented in the comparative bar charts of FIG. 6. In general, the HODF of Deadmeat™ broadhead was 12.53 grams and the HODF of BMP was 12.98 grams or within 4% of the Deadmeat™ broadhead, and the HODF of the Conventional Field Point was 10.78 grams, or within 14% of the Deadmeat™ broadhead.

As a result of the head on aerodynamic drag force testing, the head on aerodynamic drag force of the practice tip 10 was within 4% of the head on drag force as compared to the Deadmeat™ hunting broadhead 110. In contrast, the Conventional Field Tip was only within 14% of the head on aerodynamic drag force when compared to the head on aerodynamic drag force of the Deadmeat™ hunting broadhead 110. This resulted in the surprising and unexpected fourfold improvement in mimicking or reproducing the head on aerodynamic drag force of the hunting broadhead 110 with the practice tip 10 over the Conventional Field Tip.

Additional conclusions were drawn from the head on drag force testing. For example, the practice field tip 10 has a second head on aerodynamic drag that is within 40% of, or less than 40% above and less than 40% below, a first head on aerodynamic drag of the hunting broadhead 110. This variance is shown at F in FIG. 6. Further, the practice field tip 10 has a second head on aerodynamic drag that is within 25% of, or less than 25% above and less than 25% below, a first head on aerodynamic drag of the hunting broadhead 110. This variance is shown at G in FIG. 6. Even further, the practice field tip 10 has a second head on aerodynamic drag that is within 10% of, or less than 10% above and less than 10% below, a first head on aerodynamic drag of the hunting broadhead 110. This variance is shown at H in FIG. 6. Yet further, the practice field tip 10 has a second head on aerodynamic drag that is within 5% of, or less than 5% above and less than 5% below, a first head on aerodynamic drag of the hunting broadhead 110. This variance is shown at I in FIG. 6.

Figure 5:
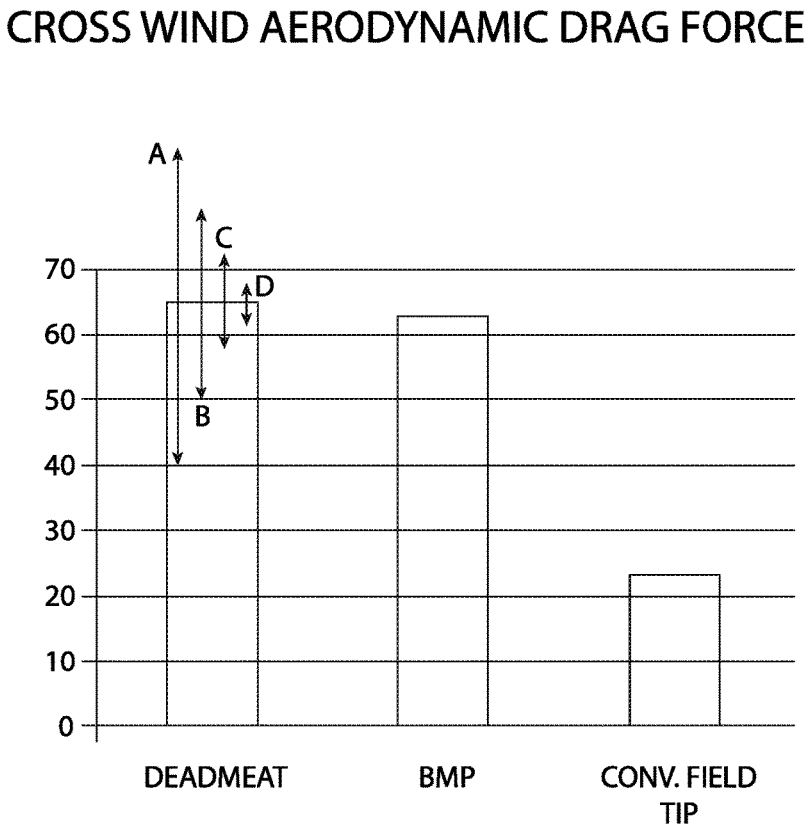
FIG. 5 is a bar chart illustrating a comparison of crosswind aerodynamic drag of the practice tip of the current embodiment with an actual hunting broadhead that the practice tip is designed to mimic in flight, and with a conventional field tip.

To perform the crosswind testing, the practice tip 10, scaled up 3× from an actual size, was placed on a stationary fixture so that the tip was facing transverse, for example, perpendicular to the wind direction, with the longitudinal axis perpendicular to the cross wind. As a result, the practice tip was subjected to an aerodynamic cross wind drag force CWDF, for example, as shown in FIG. 4. This cross wind drag force is created by air moving at 4000 fpm, transverse to the longitudinal axis LA, over the various surfaces of the practice tip 10. As the tip was subjected to the air flow, the wind tunnel machine measured the aerodynamic crosswind of the practice tip in grams. Five measurements were taken for the practice tip, and then averaged. The same procedure was repeated for the 3× scaled up actual broadhead, that is, the Deadmeat™ broadhead shown in FIGS. 1-4. If desired, the order of the measurements can be reversed, with the actual broadhead being measured first, then the practice tip, or other tips. Lastly, the same procedure was repeated for a 3X scaled up version of the Saunders Bullet Point Conventional Field Tip. The average crosswind drag forces in grams for each of the scaled up Deadmeat™ broadhead, the ballistically matched practice tip (BMP) and the Conventional Field Tip are presented in the comparative bar charts of FIG. 5. In general, the CWDF of Deadmeat™ was 64.90 grams, the CWDF of BMP is 62.90 grams, or within 3% of the Deadmeat™ broadhead, and the CWDF of the Conventional Field Point was 23.28 grams, or within 64% of the Deadmeat™ Broadhead.

As a result of the testing, the crosswind drag force of the practice tip 10 was within 3% of the crosswind drag force as compared to the Deadmeat™ hunting broadhead 110. In contrast, the Conventional Field Tip was only within 64% of the crosswind drag force when compared to the crosswind drag force of the Deadmeat™ hunting broadhead 110. This resulted in a surprising and unexpected twenty-one fold improvement in mimicking or reproducing the crosswind aerodynamic drag force of the hunting broadhead 110 with the practice tip 10 over the Conventional Field Tip.

Additional conclusions were drawn from the crosswind drag force testing. For example, the practice field tip 10 has a second crosswind aerodynamic drag that is within 40% of, or less than 40% above and less than 40% below, a first crosswind aerodynamic drag of the hunting broadhead 110. This variance is shown at A in FIG. 5. Further, the practice field tip 10 has a second crosswind aerodynamic drag that is within 25% of, or less than 25% above and less than 25% below, a first crosswind aerodynamic drag of the hunting broadhead 110. This variance is shown at B in FIG. 5. Even further, the practice field tip 10 has a second crosswind aerodynamic drag that is within 10% of, or less than 10% above and less than 10% below, a first crosswind aerodynamic drag of the hunting broadhead 110. This variance is shown at C in FIG. 5. Yet further, the practice field tip 10 has a second crosswind aerodynamic drag that is within 5% of, or less than 5% above and less than 5% below, a first crosswind aerodynamic drag of the hunting broadhead 110. This variance is shown at D in FIG. 5.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery broadhead kit comprising:

(a) a broadhead comprising:

a first ferrule having a first longitudinal axis;

a first stem configured to join with an arrow insert, the stem joined with the first ferrule at a first end;

a first tip included with the first ferrule at a second end distal from the first end;

a blade extending from the first ferrule, the blade having a cutting edge; and (b) a practice field tip comprising:

a second ferrule different in shape from the first ferrule and having a second longitudinal axis;

a second stem configured to join with the arrow insert, the stem joined with the second ferrule at a first end;

a second tip joined with the second ferrule at a second end distal from the first end; and an aerodynamic drag promoting element joined with the second ferrule distal from the second tip, the aerodynamic drag promoting element being configured to increase the amount of aerodynamic drag experienced by the practice field tip in flight, wherein the practice field tip is void of any blade, whether sharpened for cutting or not sharpened for cutting, whereby the practice field tip has substantially the same aerodynamic flight characteristics of the broadhead.

2. The archery broadhead kit of claim 1, wherein the second ferrule includes a shoulder, configured to engage at least one of an arrow and an arrow insert, wherein the aerodynamic drag promoting element is a scoop adjacent the shoulder and projects outward from the second longitudinal axis, wherein the aerodynamic drag promoting element includes a first well adjacent the second longitudinal axis;

wherein the aerodynamic drag promoting element terminates at an outer scoop lip.

3. The archery broadhead kit of claim 2, wherein the scoop is flanked by first and second fins that each project away from the second longitudinal axis and terminate at an outer fin edge.

4. The archery broadhead kit of claim 1, wherein the aerodynamic drag promoting element includes a first scoop and a second scoop, the first scoop including a first scoop upper edge and the second scoop including a second scoop upper edge, wherein the second ferrule includes a first fin projecting away from the longitudinal axis, wherein the first fin includes a first landing extending from the first scoop upper edge to the second scoop upper edge, wherein the first scoop includes a first well that is rounded and concave toward the second longitudinal axis, wherein the second scoop includes a second well that is substantially identical to the first well, and is rounded and concave toward the second longitudinal axis.

5. The archery broadhead kit of claim 1, wherein the aerodynamic drag promoting element includes a head on aerodynamic drag promoting scoop that transitions to a crosswind aerodynamic drag promoting scoop that extends forward toward the second tip.

6. The archery broadhead kit of claim 5, wherein the aerodynamic head on drag promoting scoop includes a first well;

wherein the crosswind aerodynamic drag promoting scoop includes a second well that is substantially parallel to the second longitudinal axis, wherein the first well is adjacent the second well.

7. The archery broadhead kit of claim 1, wherein the aerodynamic drag promoting element includes a crosswind aerodynamic drag promoting scoop that transitions toward first and second fins that are void of cutting edges, wherein the first and second fins include outer edges through which a reference line extends, wherein the head on aerodynamic drag promoting element is a scoop that extends away from the second longitudinal axis and beyond the reference line.

8. The archery broadhead kit of claim 1, wherein the first ferrule is of a first length extending from a first shoulder to the first tip, wherein the second ferrule is of a second length extending from a second shoulder to the second tip, wherein the second length is greater than the first length.

9. An archery practice field tip comprising:

a ferrule;

a stem configured to join with an arrow insert, the stem joined with the ferrule at a first end;

a tip joined with the ferrule at a second end distal from the first end, with a longitudinal axis extending from the first end to the second end;

a head on aerodynamic drag promoting element joined with the ferrule distal from the tip, the aerodynamic drag promoting element being configured to increase the amount of head on drag on the archery practice field tip in flight; and a crosswind aerodynamic drag promoting element joined with the ferrule adjacent the head on aerodynamic drag promoting element, the crosswind aerodynamic drag promoting element being configured to increase the amount of crosswind drag experienced on the practice field tip in flight, wherein the archery practice field tip is void of any cutting edges;

wherein the archery practice field tip is void of any blade, whether sharpened for cutting or not sharpened for cutting, whereby the archery practice field tip mimics the aerodynamic flight characteristics of a hunting broadhead having cutting edges.

10. The archery practice field tip of claim 9, wherein the head on aerodynamic drag promoting element is a first scoop having a first concave surface that opens forward generally toward the tip;

wherein the crosswind aerodynamic drag promoting element is a second scoop having a second concave surface that opens outward, away from the longitudinal axis.

11. The archery practice field tip of claim 9, wherein the crosswind aerodynamic drag promoting element includes a first scoop and a second scoop, the first scoop including a first scoop upper edge and the second scoop including a second scoop upper edge, wherein the ferrule includes a first fin projecting away from the longitudinal axis, wherein the first fin includes a first landing extending from the first scoop upper edge to the second scoop upper edge, wherein the first scoop includes a first well that is rounded and concave toward the longitudinal axis, wherein the second scoop includes a second well that is substantially identical to the first well, and is rounded and concave toward the longitudinal axis.

12. The archery practice field tip of claim 9, wherein the second concave surface includes a uniform curvature between first and second fins, wherein the first concave surface forms a curvilinear line that curves outward away from the longitudinal axis, the curvilinear line being in a plane that passes through the longitudinal axis and a well of the first concave surface.

13. The archery practice field tip of claim 9, wherein the ferrule, stem, tip, head on aerodynamic drag promoting element and crosswind aerodynamic drag promoting element are formed as a monolithic one piece unit having no moving parts and no replaceable parts.

14. A method of manufacturing a practice field tip comprising:

measuring at least one of a first head on aerodynamic drag and a first crosswind aerodynamic drag of a hunting broadhead, the hunting broadhead having a first shape and a sharpened cutting edge;

forming a practice field tip, including a second shape different from the first shape and an aerodynamic drag promoting element not present on the hunting broadhead, the practice field tip being void of a sharpened cutting edge, so that the practice field tip has at least one of:

(a) a second head on aerodynamic drag that is less than 40% above and less than 40% below the first head on aerodynamic drag of the hunting broadhead, and (b) a second crosswind aerodynamic drag that is less than 40% above and less than 40% below the first crosswind aerodynamic drag of the hunting broadhead, wherein the practice field tip is void of any blade, whether sharpened for cutting or not sharpened for cutting.

15. The method of claim 14 wherein the forming includes molding the practice field tip in a mold.

16. The method of claim 14 wherein the forming includes milling the practice field tip in a CNC machine.

17. The method of claim 14, comprising:

forming the practice field tip so that the practice field tip has the second head on aerodynamic drag that is less than 25% above and less than 25% below the first head on aerodynamic drag of the hunting broadhead, and so that the practice field tip has the second crosswind aerodynamic drag that is less than 25% above and less than 25% below the first crosswind aerodynamic drag of the hunting broadhead.

18. The method of claim 14, comprising:

forming the practice field tip so that the practice field tip has the second head on aerodynamic drag that is less than 10% above and less than 10% below the first head on aerodynamic drag of the hunting broadhead, and so that the practice field tip has the second crosswind aerodynamic drag that is less than 10% above and less than 10% below the first crosswind aerodynamic drag of the hunting broadhead.

19. The method of claim 14, comprising:

forming the practice field tip so that the practice field tip has the second head on aerodynamic drag that is less than 5% above and less than 5% below the first head on aerodynamic drag of the hunting broadhead, and so that the practice field tip has the second crosswind aerodynamic drag that is less than 5% above and less than 5% below the first crosswind aerodynamic drag of the hunting broadhead.

20. The method of claim 14 comprising:

producing the practice field tip to include a first scoop and a second scoop, the first scoop including a first scoop upper edge and the second scoop including a second scoop upper edge, wherein the practice field tip includes a first fin projecting away from a longitudinal axis of the practice field tip, wherein the first fin includes a first landing extending from the first scoop upper edge to the second scoop upper edge, wherein the first scoop includes a first well that is rounded and concave toward the longitudinal axis, wherein the second scoop includes a second well that is substantially identical to the first well, and is rounded and concave toward the longitudinal axis.

* * * * *